US011414612B2

(12) United States Patent
Choung et al.

(10) Patent No.: US 11,414,612 B2
(45) Date of Patent: Aug. 16, 2022

(54) PROCESS FOR COAL FINE AGGREGATION

(71) Applicant: TECK COAL LIMITED, Vancouver (CA)

(72) Inventors: Jae Won Choung, Sparwood (CA); Jayson Christopher Stirling, Fernie (CA)

(73) Assignee: TECK COAL LIMITED, Vancouver (CA)

( * ) Notice: Subject to any disclaimer, the term of this patent is extended or adjusted under 35 U.S.C. 154(b) by 0 days.

(21) Appl. No.: 17/287,098

(22) PCT Filed: Sep. 24, 2019

(86) PCT No.: PCT/CA2019/051361

§ 371 (c)(1),
(2) Date: Apr. 20, 2021

(87) PCT Pub. No.: WO2020/087153

PCT Pub. Date: May 7, 2020

(65) Prior Publication Data

US 2021/0355395 A1 Nov. 18, 2021

Related U.S. Application Data

(60) Provisional application No. 62/752,171, filed on Oct. 29, 2018.

(51) Int. Cl.

| | |
|---|---|
| ***C10L 5/14*** | (2006.01) |
| ***C10L 5/04*** | (2006.01) |
| ***C10L 5/36*** | (2006.01) |

(52) U.S. Cl.

CPC ..... *C10L 5/14* (2013.01); *C10L 5/04* (2013.01); *C10L 5/363* (2013.01);
(Continued)

(58) Field of Classification Search

CPC .... C10L 5/14; C10L 5/04; C10L 5/363; C10L 2250/04; C10L 2250/06; C10L 2290/08;
(Continued)

(56) References Cited

U.S. PATENT DOCUMENTS

| | | | |
|---|---|---|---|
| 3,655,350 | A | 4/1972 | Utley |
| 4,003,717 | A | 1/1977 | Cass et al. |

(Continued)

FOREIGN PATENT DOCUMENTS

| | | | |
|---|---|---|---|
| CN | 102834181 | A | 12/2012 |
| CN | 106029199 | A | 10/2016 |

(Continued)

OTHER PUBLICATIONS

International Patent Application No. PCT/CA2019/051361, International Search Report and Written Opinion dated Nov. 14, 2019.

(Continued)

*Primary Examiner* — Cephia D Toomer

(74) *Attorney, Agent, or Firm* — Borden Ladner Gervais LLP; Geoffrey deKleine

(57) ABSTRACT

A process of aggregating coal fines in a coal flotation concentrate includes dewatering the coal flotation concentrate to reduce moisture content and provide a dewatered flotation concentrate, mixing the dewatered flotation concentrate with a binder to provide a mixture, compacting the mixture under pressure to provide a green body of aggregated coal fines, having a sufficient strength for handling utilizing typical commercial methods of conveying and shipping.

11 Claims, 1 Drawing Sheet

(52) U.S. Cl.
CPC ..... *C10L 2250/04* (2013.01); *C10L 2250/06* (2013.01); *C10L 2290/08* (2013.01); *C10L 2290/24* (2013.01); *C10L 2290/30* (2013.01); *C10L 2290/546* (2013.01); *C10L 2290/547* (2013.01); *C10L 2290/58* (2013.01)

(58) Field of Classification Search
CPC ..... C10L 2290/24; C10L 2290/30; C10L 2290/546; C10L 2290/547; C10L 2290/58
See application file for complete search history.

(56) References Cited

U.S. PATENT DOCUMENTS

| | | | | |
|---|---|---|---|---|
| 5,061,082 | A | 10/1991 | Steele, Jr. | |
| 5,743,924 | A * | 4/1998 | Dospoy | C10L 5/04 44/553 |
| 5,797,972 | A | 8/1998 | Schulz | |
| 7,192,178 | B2 | 3/2007 | Whittaker, Jr. et al. | |
| 7,510,320 | B2 | 3/2009 | Whittaker, Jr. et al. | |
| 2012/0317878 | A1 * | 12/2012 | Taulbee | C10L 5/04 44/530 |

FOREIGN PATENT DOCUMENTS

| | | | |
|---|---|---|---|
| CN | 106590796 | A | 4/2017 |
| WO | 9010052 | A1 | 9/1990 |
| WO | 9828384 | A1 | 7/1998 |

OTHER PUBLICATIONS

International Patent Application No. PCT/CA2019/051361, International Preliminary Report on Patentability dated Jan. 21, 2021.
Chinese Patent Application No. 201980071185.6, Office Action dated May 11, 2022.

* cited by examiner

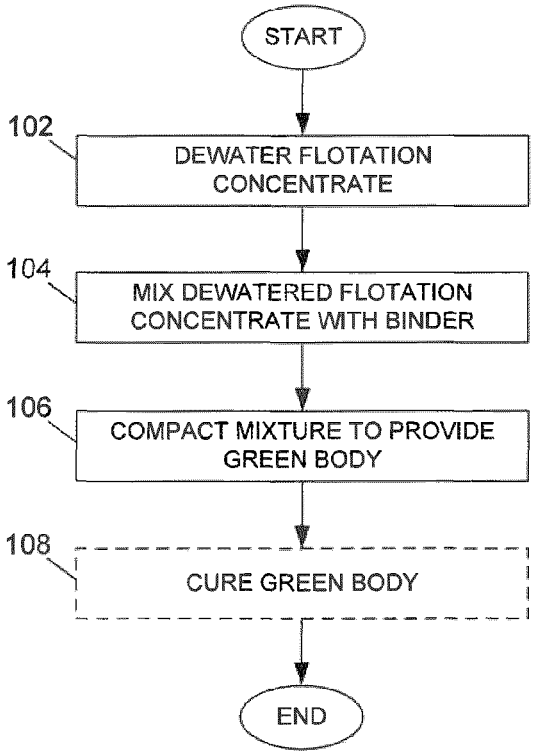
START
102
DEWATER FLOTATION CONCENTRATE
104
MIX DEWATERED FLOTATION CONCENTRATE WITH BINDER
106
COMPACT MIXTURE TO PROVIDE GREEN BODY
108
CURE GREEN BODY
END

PROCESS FOR COAL FINE AGGREGATION

TECHNICAL FIELD

The present application relates to aggregation of fine coal particles.

BACKGROUND

Fine coal particles, including coals containing large portion of ultra-fines of less than 0.15 mm in diameter or less, introduce difficulties in material handling of saleable coals. Such fine coal particles may cause difficulty in handling in chutes and bins, introduce environmental concerns such as dusting concerns, and may interfere with gas take-up systems in metallurgical coke-making. To address the issues introduced by fine coal particles, aggregation of the fine particles into larger diameter aggregates is desirable.

Such aggregation generally includes pressure roll compression, also referred to as briquetting, or extrusion with thermally dried coal fines. In order to bond particles together strongly, a binder material has been added before the aggregation. In this case, curing the aggregates is required.

Agglomeration of fine particles in a slurry or powder form has also been proposed by mixing with a binder to produce particles weakly held together, referred to as agglomerates. Depending on the water content, the agglomerates are either screened out from the water or disk or pan pelletized. For example, U.S. Pat. No. 3,637,464 discloses agglomerating coal fines by adding a liquid hydrocarbon to an aqueous dispersion of the fines and agitating the mixture to form size-enlarged agglomerates. These agglomerates are phase-separated and dried in a thermal dryer.

U.S. Pat. No. 4,830,637 discloses increasing the size distribution of a coal product by mixing dewatered coal fines and recycled fine coal from the thermal dryer cyclone in a pin-mixer to form agglomerates that are further dried to a pre-desired moisture content. A binder is added in the pin-mixer.

U.S. Pat. No. 3,655,350 discloses producing balled coal pellets by spraying a heated coal tar pitch binder onto fine particles of coal having a moisture content of about 12% to about 30% in a mixing vessel, followed by pelletizing and drying.

International Publication WO 90/10052 describes a briquetting process without using a binder. This process includes drying wet coal in the temperature range of 75 to 200 degrees Celsius, compressing the dried materials in the pressure range of 30,000 to 50,000 psi, and cooling the briquettes.

The prior art discloses methods to produce either aggregate or agglomerate from fine coal particles. Due to the week strength of agglomerate, prior art agglomeration technologies have not been fully commercialized. Although prior art aggregation technologies provide sufficient strength of aggregate to reduce the chance that the coal particles degrade back into smaller particles during material handling, thermal drying stages, one at material preparation before aggregation, and another at curing after the aggregation, are required, rendering such methods less economical. Further improvements in aggregation of fine coal particles is desirable.

SUMMARY

According to one aspect, a process of aggregating coal fines in a coal flotation concentrate is provided. The process includes dewatering the flotation concentrate to reduce moisture content and provide a dewatered flotation concentrate, mixing the dewatered coal flotation concentrate with a binder to provide a mixture, and compacting the mixture under pressure to provide a green body of aggregated coal fines.

The resulting green body has sufficient strength for handling utilizing typical commercial methods of conveying and shipping. Utilizing the process herein, neither thermal drying of wet coals before aggregation nor thermal drying of green body after aggregation is necessary.

BRIEF DESCRIPTION OF THE DRAWINGS

Embodiments of the present application will now be described, by way of example only, with reference to the attached FIGURE, in which:

FIG. 1 is a simplified flowchart illustrating a process for aggregating coal fines in a coal flotation concentrate.

DETAILED DESCRIPTION

For simplicity and clarity of illustration, numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

The disclosure generally relates to a process of aggregating coal fines in a coal flotation concentrate. The process includes dewatering the coal flotation concentrate to reduce moisture content and provide a dewatered flotation concentrate, mixing the dewatered coal flotation concentrate with a binder to provide a mixture, and compacting the mixture under pressure to provide a green body of aggregated coal fines.

The presence of fine coal particles, and, in particular, coals containing large portion of ultra-fines of about 0.15 mm in diameter or less, in saleable coals is undesirable. Aggregation of such fine coal particles into larger diameter aggregates has been proposed. Sufficient strength of the aggregated particles is desirable, however, to reduce the chance that the coal particles degrade back into smaller particles during material handling.

A flowchart illustrating a process for aggregating coal fines in a coal flotation concentrate is illustrated in FIG. 1. The process may include additional or fewer steps than shown or described with reference to FIG. 1.

The flotation concentrate, which is a slurry of coal fines having a particle size of 0.5 mm in diameter or less, is dewatered at 102 to reduce the moisture content to less than 30% by weight, providing a dewatered flotation concentrate. The flotation concentrate, having particle sizes of 0.5 mm or less is dewatered to reduce the moisture content to a content in the range of about 15% by weight to about 28% by weight. Optionally the dewatering may be carried out utilizing screen bowl centrifugation. Alternatively, dewatering may be carried out utilizing other centrifuge techniques or utilizing a vacuum disc filter.

After dewatering, the dewatered flotation concentrate is mixed with a binder at 104 to provide a mixture, for example, utilizing a pug-mill mixer. The binder may be a liquid or solid that results in bonding strength between particles. However, some solid or semi-solid binders including tar, pitch, cement, clay, starch, and so forth, contain significant amounts of incombustible materials. Therefore, when the final aggregated coal product is combusted, part of these binders or the entirety of these binders remain as an impurity. A polymeric organic binder, which generally contains a negligible quantity of impurity, may be utilized at a dosage of about 5% by weight or less to provide sufficient bonding strength between particles. Such binders may provide waterproofing or improved resistance to degradation in the presence of water, as well as improved plasticity of resulting green bodies after compaction. In one example, a polymeric binder from SNF Canada (Flodri DP/BQ 87 or DP/GBR 5027) may be added utilizing a binder dosing equipment such as a spray system for a liquid form binder, a screw feeder for a powder form binder, or a combination thereof, for example, when two different forms of binder are utilized. The binder may be added at a dosage of from about 0.2% by weight to about 5% by weight.

The mixture is then subjected to compaction at 106 to produce a green body, such as a cylindrical pellet. The mixture may be compacted by extruding in a pelletizing extruder. An extruder including a vacuum system for de-airing may be advantageous. One suitable extruder is a multi-hole pelletizing extruder available from J.C. Steele & Sons, Inc. The mixture may compacted at a pressure of about 500 psi or greater. For example, the extrusion may be carried out using a pressure of from about 200 psi to about 1000 psi.

As indicated above, the binder provides improved plasticity of resulting green bodies after compaction. In addition, the binder may provide improved resistance to degradation in the presence of water. For example, Flodri DP/GBR 5027 provides such improved resistance to degradation in the presence of water. The improved plasticity results in a green body that has sufficient strength such that thermal curing is unnecessary to increase the strength. Further, resistance to degradation in the presence of water further reduces the chance that the green bodies degrade back into smaller particles during material handling.

The compaction results in a green body of, for example, about 12 mm to about 25 mm in diameter. The green body may optionally be cured at 108 in the atmosphere to improve the strength. The green body may be also dried in a thermal dryer in order to enhance the curing and controlling the final moisture. Because of the plasticity of the green body after compaction, however, the chance that the green body breaks down into smaller particles prior to curing is less by comparison to briquettes or pellets produced utilizing prior art techniques. The green body may therefore be conveyed and shipped without the curing.

The following examples are submitted to further illustrate embodiments of the present invention. These examples are intended to be illustrative only and are not intended to limit the scope of the present invention.

Example 1

The following example demonstrates parameters utilized to provide aggregated coal fine bodies.

In this example, flotation concentrates having a moisture content of 78% and a particle size of minus 32 mesh Tyler Sieve Size, were dewatered using a vacuum filter. The moisture content was reduced to 28% by weight by the dewatering to produce a dewatered flotation concentrate, referred to as a filter cake. The filter cake was then placed in a pug mill mixer and a polymeric liquid binder, Flodri DP/BQ 87, provided by SNF Canada, was added into the filter cake at 0.3% by weight. After mixing for 10 minutes, the mix was extruded using a multi-hole 16 mm diameter pelletizing extruder available from J.C. Steele & Sons, Inc., to produce a green pellet. After the extrusion, the compressive strength of the green pellet was 2.25 KgF. The green pellet was dried in the atmosphere. After drying for 24 hours, the moisture content was below 2%. The strength was over 4.8 KgF, which is suitable for handling utilizing typical commercial methods of conveying and shipping. For a demonstration purpose, the green pellet was dried at 40 degrees Celsius in a convection oven for 24 hours to provide a cured pellet. The compressive strength of the cured pellet exceeded 6 KgF. This example illustrates the production of an aggregated and cured coal body having a strength that is suitable for handling utilizing typical commercial methods of conveying and shipping.

Example 2

The following example demonstrates the effect of lower moisture content and coarser particle size distribution on the process for aggregating coal fines.

In this example, coal fines having a particle size of minus 16 mesh Tyler Sieve Size from a steelmaking coal processing plant were dewatered to a moisture content of 18% by weight to produce a filter cake. The filter cake was then placed in a pug mill mixer and a polymeric liquid binder, Flodri DP/BQ 87, provided by SNF Canada, was added into the filter cake at 0.5% by weight. After mixing for 10 minutes, the mix was extruded using a multi-hole 16 mm diameter pelletizing extruder available from J.C. Steele & Sons, Inc., to produce a green pellet.

Because of the lower moisture content and coarser particle size distribution, green pellets having a better compressive strength and resistance, by comparison to the green pellets produced in Example 1 above, were expected. However, frequent line-plugging issues occurred during the extrusion. An intensive shearing step including longer mixing time was introduced before the extrusion, to change the fluid property of the cake from dilatant (shear thickening) to pseudoplastic (shear thinning). Plugging issues were reduced and green pellets were produced. It was observed that the rheology properties (i.e. dilatation and plasticity) of steelmaking coal were reduced due to the size degradation during the shearing step.

Example 3

The following example demonstrates the effect of binder selection and pellet size on the process for aggregating coal fines.

In this example, flotation concentrates having a moisture content of 78% and a particle size of minus 32 mesh Tyler Sieve Size, were dewatered using a solid bowl centrifuge. The moisture content was reduced to 24% by weight by the dewatering to produce a dewatered flotation concentrate, referred to as a centrifuge cake. The centrifuge cake was then placed in a pug mill mixer and a polymeric liquid binder, Flodri DP/GBR 5027, provided by SNF Canada, was added into the centrifuge cake at 2.5% by weight. After mixing for 1-2 minutes, the mix was extruded using a multi-hole 19 mm diameter pelletizing extruder available from J.C. Steele & Sons, Inc., to produce a green pellet. After the extrusion, the compressive strength of the green pellet exceeded 4 KgF, which is a sufficient strength for handling utilizing typical commercial methods of conveying and shipping. For demonstration purposes, the green pellet was dried in the atmosphere. After drying for 24 hours, the moisture content was below 2%. The strength was over 6

KgF. The green pellet was also dried at 40 degrees Celsius in a convection oven for 24 hours to provide a cured pellet with the moisture of less than 1% by weight. The compressive strength of the cured pellet exceeded 9 KgF. This example illustrates the production of an aggregated green coal body having sufficient strength that is suitable for handling utilizing typical commercial methods of conveying and shipping.

The green pellet produced in Example 3 had sufficient strength of over 6 KgF after drying in the atmosphere only. While further curing increased the compressive strength, the green pellet exhibited sufficient strength for handling utilizing typical commercial methods of conveying and shipping. Thus, sufficient strength of the green pellet is achievable in the absence of curing.

Advantageously, the process of dewatering, mixing with a binder, followed by compacting to produce a green body that is then dried, produces an aggregated coal body having an improved strength for handling utilizing typical commercial methods of conveying and shipping.

In the preceding description, for purposes of explanation, numerous details are set forth in order to provide a thorough understanding of the embodiments of the application. However, it will be apparent to one skilled in the art that these specific details are not required in order to practice the application.

The above-described embodiments of the invention are intended to be examples only. Alterations, modifications, and variations may be effected to the particular embodiments by those skilled in the art. Thus, the scope of the claims should not be limited by the embodiments set forth in the examples, but should be given the broadest interpretation consistent with the description as a whole.

What is claimed is:

1. A process for aggregating coal fines in a coal flotation concentrate, the process comprising:

dewatering the coal flotation concentrate by centrifugation or vacuum disc filtration in the absence of thermal drying to reduce moisture content and provide a dewatered flotation concentrate;

mixing the dewatered flotation concentrate with a binder to provide a mixture; and compacting the mixture by extruding at a pressure of 500 psi (3447.38 kPa) or greater or extruding at a pressure of from 200 psi (1378.95 kPa) to 1000 psi (6894.76 kPa) to provide a green body of aggregated coal fines and atmospheric drying the green body.

2. The process of claim 1, wherein dewatering comprises dewatering to reduce the moisture content to less than 30% by weight.

3. The process of claim 1, wherein mixing comprises mixing the dewatered coal flotation concentrate with a polymeric binder.

4. The process of claim 1, comprising drying the green body to further reduce the moisture content of aggregated coal.

5. The process of claim 1, wherein compacting comprises extruding the mixture at the pressure of 500 psi (3447.38 kPa) or greater.

6. The process of claim 1, wherein compacting comprises extruding the mixture at the pressure of from 200 psi (1378.95 kPa) to 1000 psi (6894.76 kPa).

7. The process of claim 1, comprising drying the green body to a moisture content of 6% by weight or less.

8. The process of claim 1, wherein compacting comprises extruding to form a green pellet of about 12 to about 25 mm in diameter.

9. The process of claim 8, comprising drying to provide a dried pellet of about 12 to about 25 mm in diameter.

10. The process of claim 1, wherein coal fines have a particle size of 0.5 mm in diameter or less.

11. The process of claim 1, wherein coal fines have a particle size of 0.15 mm in diameter or less.

* * * * *